United States Patent [19]

Coonrod

[11] Patent Number: 4,988,106

[45] Date of Patent: Jan. 29, 1991

[54] GOLFER'S PUTTING DEVICE

[76] Inventor: Ralph E. Coonrod, 8317 Spring Valley Rd., Belton, Mo. 64012

[21] Appl. No.: 472,850

[22] Filed: Jan. 31, 1990

Related U.S. Application Data

[63] Continuation-in-part of Ser. No. 285,409, Dec. 16, 1988, abandoned.

[51] Int. Cl.[5] ..... A63B 67/02

[52] U.S. Cl. ..... 273/176 F; 273/176 J; 273/176 H

[58] Field of Search ..... 273/176 F, 176 FA, 176 FB, 273/176 E, 176 G, 176 H, 176 J, 176 K, 176 L, 178 B, 178 R, 195 R, 195 A, 183 A, 32 R

[56] References Cited

U.S. PATENT DOCUMENTS

| | | | |
|---|---|---|---|
| 1,611,660 | 12/1926 | Manly | 273/176 J |
| 2,057,504 | 10/1936 | Schafer | 273/176 FB |
| 2,124,123 | 7/1938 | Rosengarten | 273/195 R |
| 2,606,028 | 8/1952 | Zion | 273/176 F |
| 2,794,646 | 6/1957 | Knott | 273/176 F |
| 3,038,726 | 6/1962 | Hesidence | 273/176 F |
| 3,323,802 | 6/1967 | Riner | 273/176 F |
| 3,534,961 | 10/1970 | Tiley | 273/176 F |
| 3,669,454 | 6/1972 | Kolonel | 273/176 J |
| 3,690,673 | 9/1972 | Occhipinti | 273/176 H |
| 3,727,917 | 4/1973 | MacLean | 273/176 H |
| 3,735,988 | 5/1973 | Palmer et al. | 273/178 B |
| 3,831,001 | 8/1974 | Toomey et al. | 273/62 X |
| 3,892,412 | 7/1975 | Koo | 273/176 H |
| 4,200,417 | 7/1980 | Brown | 273/176 H |
| 4,203,604 | 5/1980 | La Grange | 273/176 FB |
| 4,275,886 | 6/1981 | Bannon | 273/178 R |
| 4,294,450 | 10/1981 | Gallic | 273/176 F |

*Primary Examiner*—George J. Marlo

*Attorney, Agent, or Firm*—Hovey, Williams, Timmons & Collins

[57] ABSTRACT

A portable, practice golf putting green presents realistic and challenging putting practice and in which all of the components can be formed into a convenient and compact storage position. The preferred putting green includes a flexible base of material presenting a playing surface providing two different resistances to the roll of a golf ball and realistically simulative of a putting green, a plurality of openings simulative of golf green cups defined in the playing surface, an elevated portion presenting one of the openings at an elevated level, and a pair of longitudinally and transversely adjustable wedges for selectively altering the contour of the playing surface.

14 Claims, 1 Drawing Sheet

GOLFER'S PUTTING DEVICE

This application is a continuation-in-part of application Ser. No. 07/285,409; filed Dec. 16, 1988, now abandoned.

BACKGROUND OF THE INVENTION

1. Field of the Invention

The present invention concerns a portable practice putting green or so-called "putting clock" having a sheet of flexible material simulative of a golf green surface with a plurality of openings defined therein simulative of golf green cups and which can be rolled into a compact coiled configuration for portability and storage.

2. Description of the Prior Art

The prior art discloses a variety of devices for putting practice by a golfer. None of the prior art devices, however, include all of the elements necessary to provide a portable practice putting green realistically simulative of an actual golf green and which is also configured for convenient and compact storage.

For example, a realistic putting green should include a cup which is elevated above the level of the starting surface because such is encountered with actual golf greens. Additionally, actual golf greens present variable contours which prevent a straight roll of the ball. A realistic practice putting green should also provide contours which can be selectively varied. Furthermore, a golfer encounters different putting distances and such should be provided by a practice green.

SUMMARY OF THE INVENTION

The problems outlined above are solved by the portable practice putting green of the present invention. That is to say, the practice putting green hereof provides realistic simulation of actual putting conditions encountered on a golf course.

The preferred putting green broadly includes a base of elongated, flexible material presenting a playing surface simulative of a golf green surface and which can be placed in a storage position wherein the base is formed into a coiled roll. The preferred embodiment also includes structure defining a plurality of openings simulative of golf green cups in the playing surfaces with at least one of the openings at an elevated level, means for selectively altering the contour of the playing surface to a desired contour in order to simulate desired golf green surface breaks, and a rail along at least a portion of the edges of the base for preventing a golf ball rolling along the playing surface from exiting therefrom.

BRIEF DESCRIPTION OF THE DRAWING FIGURES

DETAILED DESCRIPTION OF THE PREFERRED EMBODIMENT

Figure 1:
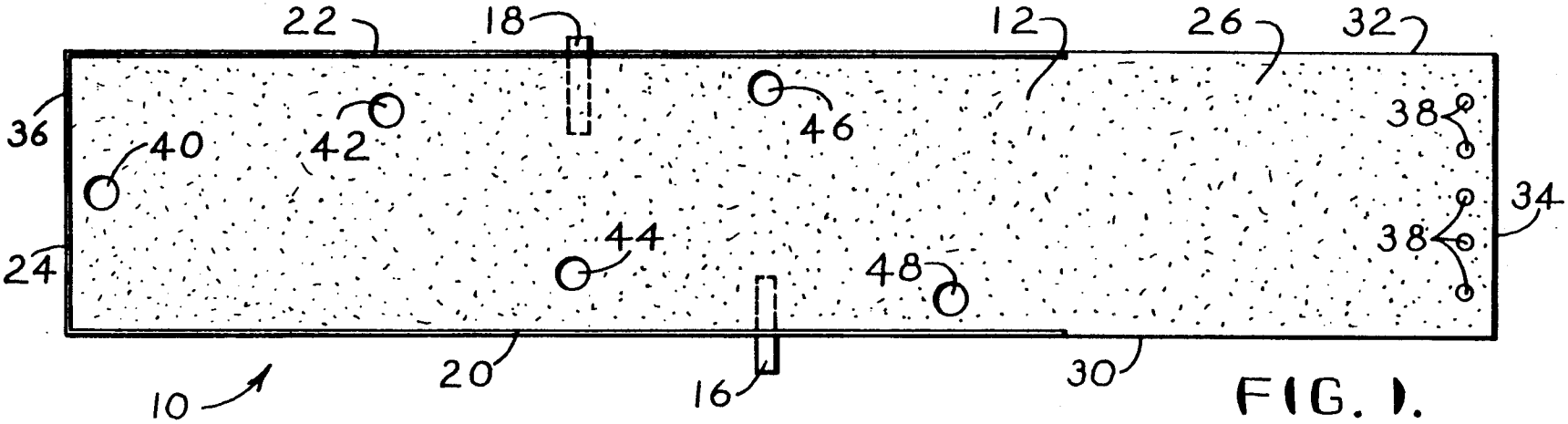
FIG. 1 is an elevational view of the preferred portable practice green showing portions of the contour-altering wedges in dashed lines.
Figure 2:
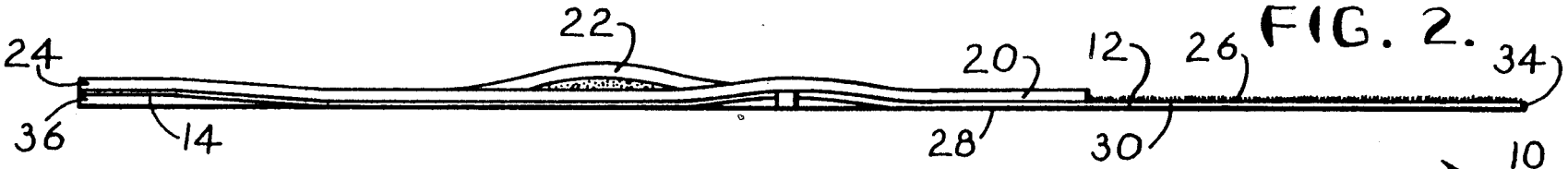
FIG. 2 is a side elevational view of the putting green of FIG. 1.

Referring now to FIGS. 1 and 2, the preferred portable practice putting green 10 includes base 12, elevation riser 14, a respective pair of contour-break wedges 16 and 18, and respective left, right, and end rails 20, 22 and 24.

Base 12 is preferably composed of an elongated, rectangularly-shaped, sheet of flexible material presenting playing surface 26 and opposed lower surface 28. Base 12 is preferably composed of rubber backed carpet material presenting a smooth-nap, upper surface as presents playing surface 26. Carpet-like material is preferred over artificial turf because it presents a playing surface more realistically simulative of an actual golf green. In the preferred embodiment, base 12 is approximately 15 feet long by 3 feet wide.

In the preferred embodiment, putting surface 26 presents respective left and right side edges 30 and 32 and respective starting and remote end edges 34 and 36. Five spaced-apart detents 38 are defined in playing surface 26 adjacent starting end edge 34 and configured to hold a golf ball in a respective starting-putt position.

In the preferred embodiment, five respective openings 40, 42, 44, 46, and 48 simulative of golf green cups are defined through playing surface 26 at relative locations as shown in FIG. 1. These openings are presented at varying distances from detents 38 in order to provide realistic distance variation for putting as encountered in actual play.

FIGS. 1 and 2 illustrate putting green 10 in a playing position in which lower surface 28 engages a support surface such as a driveway, patio, or floor.

Preferred elevation riser 14 is preferably composed of a bevelled piece of one-inch thick foam rubber material adhered by gluing to lower surface 28 adjacent remote end edge 36. Riser 14 is preferably positioned to elevate that portion of base 12 adjacent remote end edge 36 in order to correspondingly elevate opening 40 above the level of the remaining portions of base 12. Elevation riser 14 is preferably bevelled to present a gradual rise toward opening 40 and toward remote end edge 36. This provision presents opening 40 as potentially the most difficult for a practice putt.

Wedges 16, 18 are preferably composed of wood or plastic and are positioned between lower surface 28 and the support surface on which putting green 10 rests in the playing position. Wedges 16, 18 are each transversely and longitudinally adjustable relative to base 12 for selectively adjusting the contour of playing surface 26 in a manner realistically simulative of the surface break of an actual golf green.

Rails 20–24 are preferably composed of elongated strips of rubber or vinyl which are removably clipped or otherwise respectively attached adjacent left and right edges 30, 32 and remote end edge 36. The preferred flexible nature of rails 18–22 allows them to flex to conform to the contour change of playing surface 26 as it is altered by wedges 16, 18 as illustrated in FIG. 2. In the alternative, rails 20–24 can be composed of rigid wood, plastic, metal, or the like and configured in the form of an angle iron placed adjacent edges 30, 32, and 36, the only requirement being that rails 20–24 prevent a golf ball from exiting playing surface 26. As illustrated in FIGS. 1 and 2, left and right rails 20, 22 extend along left and right side edges 30, 32 approximately two-thirds of the distance from remote end edge 36 toward starting end edge 34. End rail 24 extends along remote end edge 36 spanning the distance between left and right side edges 30, 32.

Figure 3:
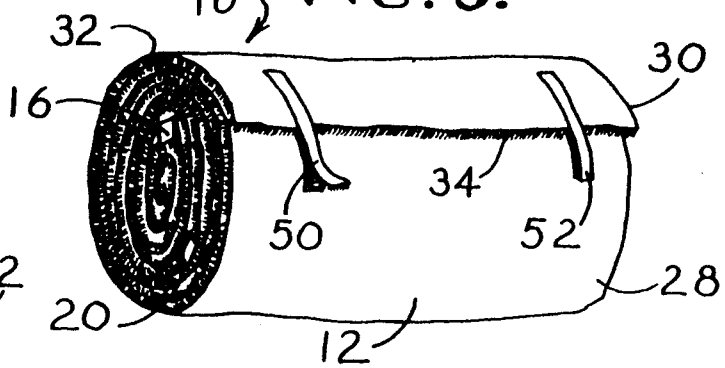
FIG. 3 is a perspective view of the putting green in its storage position.

FIG. 3 illustrates putting green 10 in a storage position in which base 12 is formed into a coiled configuration with playing surface 26 on the inside and lower surface 28 exteriorally exposed. To form this configuration, base 12 is rolled up starting at remote end edge 36 so that starting end edge 34 is exposed. As shown in FIG. 3, hook-and-eye fasteners 50 and 52 known by the trade name VELCRO releasably couple starting end edge 34 to lower surface 28 in order to releasably maintain a putting green 10 in the storage position. Advantageously, left and right rails 20, 22 are configured in sections approximately equal to the width of base 12 so that they, along with end rail 24 and wedges 16, 18, can also be rolled up for storage within the layers of base 12 when in the storage position. In this way, all of the components of putting green 10 are placed in respective storage positions for convenient and compact storage.

As those skilled in the art and in the sport of golf will appreciate, preferred putting green 10, when in use, presents a practice putting green realistically simulative of an actual golf green. In use, a golf ball can be placed in a starting position at any one of detents 38 to provide variance in position relative to openings 40–48. The different distances between detents 38 and openings 40–48 realistically simulate a variety of distances which a golfer encounters during actual play. Furthermore, contour variations resulting from the use of wedges 16, 18 simulate contour variations encountered in actual play. The respective positions of wedges 16, 18 can be further varied longitudinally and transversely to provide a wide variety of contour variations as encountered by a golfer during actual play. Finally, the elevated position of opening 40 allows a golfer to practice those putts in which the cup is elevated in respect to the starting position.

The variety of starting positions, cup distances, contour changes, and elevated cup height, all combine, in a single combined structure, to provide a wide variety of conditions simulative of those actually encountered on an actual golf green, and further provide portability and the particular convenience of a storage position for all of the components of putting green 10.

Figure 4:
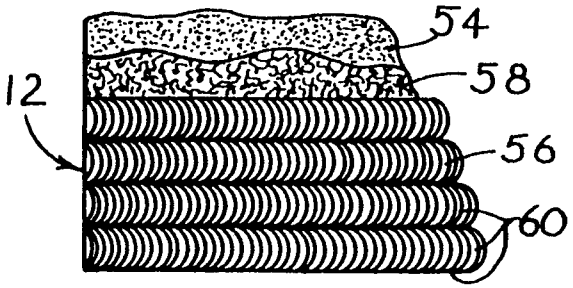
FIG. 4 is a partial plan view with portions cut away of the preferred base of the practice green.
Figure 5:
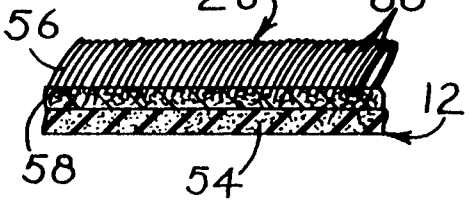
FIG. 5 is a sectional view of the base shown in FIG. 4.

FIGS. 4 and 5 illustrate preferred base 12 presenting playing surface 26 which allows the roll of a golf ball thereon to simulate realistically a golf ball roll on an actual golf green. More particularly, base 12 includes backing 54, weave 56 and scrim 58.

In the preferred embodiment, backing 54 is composed of a double coating of rubber which allows base 12 to lie flat when placed on a support surface.

The preferred weave 56 is composed on loops 60 of continuous filament fiber, and in particular, OLEFIN fiber having a face weight between about 26 and 34 ounces per square yard and preferably at 30 ounces face weight. Loops 60 are configured to present a height between and 0.300 and 0.340 inches, preferably at 0.320 inches. Loops 60 are preferred over tufted or twisted configurations, for example, because it has been found that the loops provide a better simulation.

Scrim 58 is preferably composed of a densely packed mat of NYLON fiber presenting a density between about 8 to 16 ounces per square foot, although a 10 ounce scrim is preferred.

As illustrated in FIGS. 4 and 5, loops 60 extend from backing 54 and scrim 58 in parallel, closely adjacent rows and also parallel to the long axis of base 12. Additionally, as most clearly illustrated in FIG. 5, loops 60 are inclined from vertical slightly toward remote end edge 36.

With the preferred construction of base 12, weave 56 and scrim 58 cooperate to provide a resistance to the roll of a golf ball on playing surface 26 which realistically simulates that on an actual golf green. In particular, the resistance to the roll of a golf ball in a direction from starting edge 34 toward remote edge 36, which is the direction of the nap of loops 60, provides a roll which realistically simulates that on a dry golf green. Conversely, a different resistance is provided to the roll of golf ball on playing surface 26 in an opposed direction, that is, from remote edge 36 toward starting edge 34. This simulates the roll on a wet green. Even more particularly, using a so-called STIMP meter in accordance with the U.S. Golf Association, a four-inch pull back on the meter pendulum provides a ten foot roll in a direction with the nap of loops 60 which simulates a dry green, and a roll of eight and one half feet in the opposite direction against the nap of loop 60 which simulates a wet green. Thus, as those skilled in the art will appreciate, the preferred construction of base 12 provides a playing surface which is precisely and measurably simulative of an actual golf green. To provide a simulation of other playing conditions, the height in density of loops 60 can be varied as can the density of scrim 58.

Having thus described the embodiment of the present invention, the following is claimed as new and desired to be secured by Letters Patent:

1. A practice putting green comprising:

a base of elongated material presenting a playing surface simulative of a golf green surface; and structure defining at least one opening in said playing surface simulative of a golf green cup, said base including a backing, an upstanding weave extending from said backing and composed of loops of continuous filament synthetic resin fiber presenting said playing surface, and a scrim disposed between said backing and playing surface, said weave and scrim cooperatively presenting means for providing a first resistance to the roll of a golf ball on said playing surface in a first direction and for providing a second, significantly different resistance to said roll in a second, opposed direction.

2. The practice putting green as set forth in claim 1, said backing being composed of a double coating of rubber.

3. The practice putting green as set forth in claim 1, said scrim being composed of a densely packed mat of said fiber.

4. The practice putting green as set forth in claim 3, said scrim presenting a density of between about 8 and 16 ounces per square yard.

5. The practice putting green as set forth in claim 4, said scrim presenting a density of about 10 ounces per square yard.

6. The putting green as set forth in claim 1, said weave presenting a face weight of between about 26 and 34 ounces.

7. The practice putting green as set forth in claim 6, said weave presenting a face weight of about 30 ounces.

8. The practice putting green as set forth in claim 1, said weave presenting a height of between about 0.300 and 0.340 inches above said base.

9. The practice putting green as set forth in claim 8, said weave presenting a height of about 0.320 above said backing.

10. The practice putting green as set forth in claim 1, said loops being configured in closely adjacent parallel rows and generally uniformly inclined relative to vertical to present a nap.

11. The practice putting green as set forth in claim 10, said base presenting a long axis, said rolls of loops being parallel with said long axis.

12. The practice putting green as set forth in claim 1, said second resistance being greater than said first resistance.

13. The practice putting green as set forth in claim 1, said first resistance allowing the roll of a golf ball on said playing surface of about 10 feet and second resistance allowing a roll of about 8½ feet in reaction to an equivalent energy imposed upon a golf ball thereon.

14. The practice putting green as set forth in claim 1, said base presenting a starting end edge and respective opposed side edges, and further presenting a lower surface opposed to said playing surface, said base being composed of a flexible material for allowing selective alteration between a playing position in which said lower surface is in supportive engagement with a support surface, and a storage position in which said sheet is formed into a coiled roll, structure defining a plurality of said openings in said playing surface at difference distances from said starting edge, elevation means for elevating a portion of said playing surface above the level of remaining portions of said playing surface, said elevated portion including at least one of said openings, rail means for placing adjacent the base along at least a portion of said edges for preventing a golf ball rolling on said playing surface or exiting therefrom, and break means for selectively altering the contour of said playing surface to a desired contour in order to simulate a desired golf green surface break.

* * * * *